US008349748B2

(12) United States Patent
Chen et al.

(10) Patent No.: US 8,349,748 B2
(45) Date of Patent: Jan. 8, 2013

(54) FABRICS HAVING SOIL RESISTANCE AND NO OIL STAINS AFTER WIPING AND MANUFACTURING METHOD THEREOF

(75) Inventors: Young-Chin Chen, Touliu (TW); Hsing-Nan Chung, Touliu (TW); Meng-Hsun Liu, Touliu (TW); Yao-Tsung Chen, Touliu (TW); Hsin-Yuan Chen, Touliu (TW)

(73) Assignee: Formosa Taffeta Co., Ltd., Toulin (TW)

( * ) Notice: Subject to any disclaimer, the term of this patent is extended or adjusted under 35 U.S.C. 154(b) by 614 days.

(21) Appl. No.: 12/043,425

(22) Filed: Mar. 6, 2008

(65) Prior Publication Data

US 2008/0220677 A1 Sep. 11, 2008

(30) Foreign Application Priority Data

Mar. 6, 2007 (TW) ..... 96107696 A

(51) Int. Cl.

| | |
|---|---|
| ***B32B 27/20*** | (2006.01) |
| ***B32B 5/20*** | (2006.01) |
| ***B32B 5/22*** | (2006.01) |
| ***B32B 5/30*** | (2006.01) |
| ***B32B 27/12*** | (2006.01) |
| ***B05D 1/36*** | (2006.01) |
| ***B05D 1/38*** | (2006.01) |
| ***B05D 3/12*** | (2006.01) |
| ***D06Q 1/10*** | (2006.01) |
| ***D06M 15/70*** | (2006.01) |

(52) U.S. Cl. ..... 442/93; 442/68; 442/70; 442/72; 442/74; 442/80; 442/81; 442/82; 427/412; 8/115.6

(58) Field of Classification Search ..... 442/93, 442/62, 66, 68, 70, 71, 72, 74, 75, 78, 80, 442/81, 82; 427/498, 512–515

See application file for complete search history.

(56) References Cited

U.S. PATENT DOCUMENTS

| | | | | |
|---|---|---|---|---|
| 3,639,156 | A * | 2/1972 | Pittman et al. | 442/93 |
| 7,811,949 | B2 * | 10/2010 | Snowden et al. | 442/67 |
| 2003/0207629 | A1 | 11/2003 | Sobieski et al. | |
| 2005/0272333 | A1 * | 12/2005 | Wang et al. | 442/64 |

FOREIGN PATENT DOCUMENTS

| | | | |
|---|---|---|---|
| CN | 1766222 | A | 5/2006 |
| EP | 1 652 995 | A1 | 5/2006 |
| JP | 2002 086641 | | 3/2002 |
| JP | 2005 290582 | | 10/2005 |

* cited by examiner

*Primary Examiner* — Jennifer A Steele

(74) *Attorney, Agent, or Firm* — Connolly Bove Lodge & Hutz LLP

(57) ABSTRACT

The present invention provides a fabric having soil resistance and no oil stains after wiping and a manufacturing method thereof. The fabric of the present invention comprises an underlayer and a soil-resistant protection film, which can effectively prevent oil corrosion, penetration, and permeation of the surface of the fabric, thus resulting in no oil stains after wiping. The manufacturing method of the present invention comprises the steps of dyeing, setting, performing an underlayer surface treatment to form an underlayer on a surface of the fabric, and performing a soil resistance processing treatment to form a soil-resistant protection film on the surface of the underlayer.

16 Claims, No Drawings

FABRICS HAVING SOIL RESISTANCE AND NO OIL STAINS AFTER WIPING AND MANUFACTURING METHOD THEREOF

RELATED APPLICATIONS

This application claims benefit of Taiwan application 096107696 filed Mar. 6, 2007.

FIELD OF THE INVENTION

The present invention relates to a fabric having soil resistance. More particularly, the present invention relates to a fabric having soil resistance and no oil stains after wiping and a manufacturing method thereof.

DESCRIPTION OF THE PRIOR ART

Generally speaking, the manufacturing process of a soil-resistant fabric includes dyeing, drying, surface soil resistance treatment, post-check, packaging, and shipping. The surface soil resistance treatment is performed by the use of a fluorocarbon-based or silicon-based water repelling agent as the main ingredient.

However, after a common soil resistance treatment, if the fabric surface is stained with oil, the oil dirt cannot be completely removed after wiping or washing, and then some oil stains are left, which is detrimental to the appearance of the fabric. Furthermore, if the fabric is stained with oil dirt and is washed several times, the fiber structure of the fabric will be changed, and thus the effect thereof is greatly reduced.

Currently, there are soil-resistant products available on the market, but none has the effect of no oil stains after wiping. Therefore, it is a urgent need to develop a fabric that has soil resistance, is easy to clean, and sustains no oil stains after wiping to keep a clean appearance, so as to meet the current and future requirements of functional fabrics.

SUMMARY OF THE INVENTION

In order to eliminate the disadvantages of the current soil-resistant fabrics, the present invention provides a fabric having soil resistance and no oil stains after wiping.

The fabric having soil resistance and no oil stains after wiping of the present invention includes an underlayer and a soil-resistant protection film, so as to effectively prevent oil corrosion, penetration, and permeation of the surface of the fabric, thus resulting in no oil stains after wiping.

The present invention further provides a manufacturing method of the fabric having soil resistance and no oil stains after wiping, which comprises the steps of: after dyeing and setting, performing an underlayer surface treatment on a fabric to form an underlayer on the surface of the fabric, and performing a soil resistance processing treatment to form a soil-resistant protection film on the surface of the underlayer.

DETAILED DESCRIPTION OF THE INVENTION

The fabric used in the present invention can be any synthetic, natural, or heterogeneous mixed fabric, including but not limited to polyester, polyamide, cotton, rayon, polypropylene, N/C, T/C, CVC, or leather.

In a preferred embodiment of the present invention, the surface of the fabric is roughened in a physical manner, including but not limited to corona, atmospheric plasma, or deweighting, and then an underlayer is processed onto the surface of the fabric.

In a preferred embodiment of the present invention, the underlayer comprises an inorganic oxide and a polymer. The inorganic oxide includes, but is not limited to, silicon dioxide or titanium dioxide having a particle diameter of less than about 200 nm and an amount of about 1 g/L to about 100 g/L, preferably about 5 g/L to about 30 g/L. The polymer includes, but is not limited to, polyisocyanate having an amount of about 1 g/L to about 100 g/L, preferably about 5 g/L to about 30 g/L. The soil-resistant protection film includes a Si-modified fluorocarbon-based hydrophobic compound, including but not limited to a compound comprising a Si-based hydrophobic agent of less than about 5 wt % and a fluorocarbon-based hydrophobic agent of more than about 95 wt %, and having an amount of about 5 g/L to about 100 g/L, preferably about 40 g/L to about 80 g/L. The Si-based hydrophobic agent includes, but is not limited to, silyl ($CSi_4$), and the fluorocarbon-based hydrophobic agent includes, but is not limited to, $R—CF_2:CF_3$ (where R is $C_{1-6}$alkyl).

The soil-resistant protection film is tightly joined with the fabric by the underlayer. Furthermore, as silicon is a very stable material and can prevent oil from corroding, penetrating, and permeating the surface of the fabric to form stains and marks, the fabric thus formed is soil-resistant and sustains no oil stains after wiping, which keeps the clean appearance of the fabric and improves its durability.

The present invention further provides a manufacturing method of a fabric having soil resistance and no oil stains after wiping. The manufacturing method includes: after dyeing and setting, performing an underlayer surface treatment on a fabric to form an underlayer on the surface of the fabric, and performing a soil resistance processing treatment to form a soil-resistant protection film on the surface of the underlayer.

In a preferred embodiment of the present invention, the manufacturing method of a fabric having soil resistance and no oil stains after wiping includes dyeing, setting, surface roughening treatment, underlayer surface treatment, soil resistance processing treatment, drying, curing, post-treatment (including coating), packaging, and shipping.

The processes of dyeing, setting, and surface roughening treatment are well known to those skilled in the art. The dyeing process includes dyeing the desized fabric with suitable dyestuffs, for example, acid dyestuffs, disperse dyestuffs, cationic dyestuffs, reactive dyestuffs, vat dyestuffs, or direct dyestuffs, together with a suitable dyeing assistant by a suitable dyeing machine, such as an air flow dyeing machine, jigger dyeing machine, winch dyeing machine, beam dyeing machine, jet dyeing machine, rapid dyeing machine, or continuous padding dyeing machine at a temperature of about 40° C. to about 170° C.

The underlayer surface treatment includes performing an underlayer surface treatment on the fabric by the use of an aqueous solution of an inorganic oxide and a polymer by padding process to form an underlayer on the surface of the fabric. In a preferred embodiment of the present invention, the inorganic oxide includes, but is not limited to, silicon dioxide or titanium dioxide having a particle diameter of less than about 200 nm and an amount of about 1 g/L to about 100 g/L, preferably about 5 g/L to about 30 g/L. The polymer includes, but is not limited to, polyisocyanate having an amount of about 1 g/L to about 100 g/L, preferably about 5 g/L to about 30 g/L. The pressure of the padding process is about 1.0 $kg/cm^2$ to about 4.5 $kg/cm^2$. The drying conditions include drying at a temperature of about 120° C.±60° C., preferably about 145° C.±25° C. for about 40 seconds.

The soil resistance processing treatment includes processing the fabric after surface treatment with the Si-modified fluorocarbon-based hydrophobic compound by an immersing and padding process, thus a crosslinking reaction between the processing agent and the fabric occurs, so as to join the underlayer with the fabric tightly and to form a soil-resistant protection film having the effect of soil resistance on the surface of the fabric. In a preferred embodiment of the present invention, the fluorocarbon-based hydrophobic compound includes a Si-based hydrophobic agent of less than about 5 wt % and a fluorocarbon-based hydrophobic agent of more than about 95 wt %. The Si-based hydrophobic agent includes, but is not limited to, silyl ($CSi_4$). The fluorocarbon-based hydrophobic agent includes, but is not limited to, R—$CF_2$:$CF_3$ (where R is $C_{1-6}$alkyl). The amount of the fluorocarbon-based hydrophobic compound is about 5 g/L to about 100 g/L, preferably about 40 g/L to about 80 g/L. The pressure of the padding process is about 1.0 kg/cm$^2$ to about 4.5 kg/cm$^2$. The curing temperature is 130° C.≅60° C., preferably about 110° C.±10° C. The processing rate is about 5 m/min to about 120 m/min, preferably about 40 m/min to about 60 m/min.

The processes of drying, curing, and post-treatment (including coating), packaging, and shipping are well known to those skilled in the art. The post-treatment optionally includes softening, hot and cold calendering, coating, and laminating, or special waterproof processing treatment.

For example, the fabric to be softened passes through a bath containing a softening agent, and is then sent to a waterproof machine at a suitable rate (about 35 m/min to about 55 m/min), a suitable knife height (about 60 mm to about 100 mm, preferably 80 mm), a suitable angle (about 0.75 mm to about 1.05 mm, preferably 0.95 mm) and a suitable temperature (about 110° C. to about 130° C., preferably 120° C.) for being subjected to a waterproof treatment. The fabric after waterproof treatment needs to be stored for a suitable period of time for crosslinking. Then, optionally, a post-setting is performed, and the fabric after the post-setting is the finished product.

EXAMPLES

The following embodiments are used to further illustrate but not to limit the present invention. Any modifications and variations easily made by those skilled in the art are included in the disclosure of the present invention and fall within the scope of the appended claims.

Example 1

Manufacturing of the Fabric having Soil Resistance and No Oil Stains after Wiping greige fabric→dyeing→surface treatment→underlayer process→soil-resistance process→finished product The fabric having soil resistance and no oil stains after wiping is manufactured by the following steps.

A greige fabric of 600 yard/Ba was desized and scoured at a temperature of about 90° C. and at a speed of about 60 feet/min. After desizing and scouring, the fabric was dyed, and then sent to a setting machine at a speed of about 80 m/min and at a temperature of about 180° C. Thereafter, the dyed fabric was immersed in an aqueous solution of 5 g/L of silicon dioxide having a particle diameter of 20 nm and 5 g/L of polyisocyanate to perform the surface treatment, so as to form an underlayer on the surface of the fabric. Next, the fabric was taken out and was subjected to the surface processing treatment with 60 g/L of a Si-modified fluorocarbon-based hydrophobic compound containing 4.5 wt % of silyl and 95.5 wt % of R—$CF_2$:$CF_3$ (where R is $C_{1-6}$alkyl), so as to form a soil-resistant protection film on the surface of the fabric. Then the fabric was dried at about 120° C. and cured at about 180° C., so as to form the fabric having soil resistance and no oil stains after wiping.

Comparative Example 1

Manufacturing of the Soil-Resistant Fabric by Performing the Surface Soil Resistance Treatment by the Use of a Common Fluorocarbon-Based Water Repellent as the Main Ingredient greige fabric→dyeing→water and oil repelling treatment→finished product A greige fabric of 600 yard/Ba was desized and scoured at a temperature of about 90° C. and at a speed of about 60 feet/min. After desizing and scouring, the fabric was dyed, and then sent to a setting machine at a speed of about 80 m/min and at a temperature of about 170° C. Thereafter, the water and oil repelling treatment was performed on the dyed fabric by the use of 40 g/L of a fluorocarbon-based water repellent as the main ingredient to form a soil-resistant protection film on the surface of the fabric. Then the fabric was dried at about 120° C. and cured at about 170° C. to form a soil-resistant fabric.

Quality Verification Method:

Quality Classification: (Gray Scale Judgment)

Before washing: level 4-5

After washing 5 times level 3-4

Tools Used:

a. Tissue paper (common tissue roll)
b. Oil (common edible oil, e.g., vegetable oil or liquid animal oil)
c. Burette
d. Burette clip
e. Classification box
f. Gray scale
g. Comparison labinet (D65 light source)

Operations of the Oil Droplet Dripping Test:

1. The size of the fabric sample: 27 cm (in the warp direction)×27 cm (in the weft direction)
2. Lay the fabric sample on a tabletop with the front surface of the fabric sample facing upward, and titrate 1.0 c.c. salad oil on the fabric surface from 20 cm above the fabric surface (completed in 3 seconds)
3. After the oil drops stay on the fabric surface for 30 seconds, the oil is wiped.

Operations of the Oil Droplet Wiping:

1. Fold the tissue paper into any shape to absorb the salad oil on the fabric surface, paying attention to no force on the fabric surface when wiping the oil
2. If there is salad oil left on the fabric surface, take a new piece of tissue paper to absorb it until no oil stains are left on the fabric surface. The oil stains on the fabric surface must be removed completely
3. Make marks on the fabric surface Operations of the Classification:

1. Fix the fabric sample under test on a white sample attachment card, and place it on a classification oblique plate (at an inclined angle of 45°) in a classification box, so as to classify it in a dark room
2. Select the D65 light source, observe the fabric surface with the naked eye at the same level of the fabric surface to classify it by assessing the change in color according to the gray scale Table I lists the water repellent properties, soil-resistant properties, and residual oil stains of a soil-resistant fabric (a)

of Embodiment 1 and a soil-resistant fabric (b) of Comparative Example 1 after they are tested by the quality verification method.

TABLE I

| | Water repellent properties | Soil resistant properties | Residual oil stains |
|---|---|---|---|
| Example 1 | Good | Good | None (level 4-5) |
| Comparative Example 1 | Acceptable | Not good | Yes (lower than level 2) |

In sum, the present invention utilizes an aqueous solution containing an inorganic oxide to form an underlayer on the surface of the fabric, and utilizes a Si-modified fluorocarbon-based hydrophobic compound to form a soil-resistant protection film on the surface of the underlayer, so as to join the underlayer with the fabric tightly and to form the fabric which has soil resistance, is easy to clean, and sustains no oil stains after wiping. The fabric of the present invention can keep the clean appearance of the fabric and improve its durability.

We claim:

1. A fabric having soil resistance and no oil stains after wiping, comprising a greige fabric, an underlayer and a soil-resistant protection film, wherein the underlayer is formed on a surface of the greige fabric by performing an underlayer surface treatment by the use of an aqueous solution consisting consists of an inorganic oxide and a polymer, wherein the inorganic oxide is selected from the group consisting of silicon dioxide and titanium dioxide, and wherein the polymer is polyisocyanate.

2. The fabric of claim 1, wherein a surface of the greige fabric is roughened in a physical manner and the underlayer is then processed onto the surface of the greige fabric.

3. The fabric of claim 1, wherein the inorganic oxide has a particle diameter of less than about 200 nm.

4. The fabric of claim 1, wherein the amount of the inorganic oxide is about 1 g/L to about 100 g/L, and the amount of the polymer is about 1 g/L to about 100 g/L.

5. The fabric of claim 4, wherein the amount of the inorganic oxide is about 5 g/L to about 30 g/L, and the amount of the polymer is about 5 g/L to about 30 g/L.

6. The fabric of claim 1, wherein the soil-resistant protection film comprises a Si-modified fluorocarbon-based hydrophobic compound.

7. The fabric of claim 6, wherein the Si-modified fluorocarbon-based hydrophobic compound comprises a Si-based hydrophobic agent of less than about 5 wt % and a fluorocarbon-based hydrophobic agent of more than about 95 wt %.

8. The fabric of claim 6, wherein the amount of the Si-modified fluorocarbon-based hydrophobic compound is about 5 g/L to about 100 g/L.

9. A method of manufacturing a fabric having soil resistance and no oil stains after wiping, comprising providing a greige fabric, dyeing and setting the greige fabric, performing an underlayer surface treatment to form an underlayer on a surface of the greige fabric, and performing a soil resistance processing treatment to form a soil-resistant protection film on the surface of the underlayer, wherein the underlayer surface treatment is performed by using an aqueous solution consisting of an inorganic oxide and a polymer to form the underlayer on the surface of the greige fabric, wherein the inorganic oxide is selected from the group consisting of silicon dioxide and titanium dioxide, and wherein the polymer is polyisocyanate.

10. The method of claim 9, further comprising roughening the surface of the greige fabric in a physical manner before the underlayer surface treatment.

11. The method of claim 9, wherein the inorganic oxide has a particle diameter less than about 200 nm.

12. The method of claim 9, wherein the amount of the inorganic oxide is about 1 g/L to about 100 g/L, and the amount of the polymer is about 1 g/L to about 100 g/L.

13. The method of claim 12, wherein the amount of the inorganic oxide is about 5 g/L to about 30 g/L, and the amount of the polymer is about 5 g/L to about 30 g/L.

14. The method of claim 9, wherein the soil-resistant protection film is formed on the surface of the underlayer by the use of a Si-modified fluorocarbon-based hydrophobic compound.

15. The method of claim 14, wherein the Si-modified fluorocarbon-based hydrophobic compound comprises a Si-based hydrophobic agent of less than about 5 wt % and a fluorocarbon-based hydrophobic agent of more than about 95 wt %.

16. The method of claim 14, wherein the amount of the Si-modified fluorocarbon-based hydrophobic compound is about 5 g/L to about 100 g/L.

* * * * *